US005209788A

United States Patent [19]

McMillen et al.

[11] Patent Number: 5,209,788

[45] Date of Patent: May 11, 1993

[54] NON-CHROME FINAL RINSE FOR PHOSPHATED METAL

[75] Inventors: Mark W. McMillen, Oxford; F. Leon Bergeron, Dearborn, both of Mich.

[73] Assignee: PPG Industries, Inc., Pittsburgh, Pa.

[21] Appl. No.: 616,523

[22] Filed: Nov. 21, 1990

[51] Int. Cl.[5] ..... C23C 22/80

[52] U.S. Cl. ..... 148/247; 148/257

[58] Field of Search ..... 148/247, 257, 273

[56] References Cited

U.S. PATENT DOCUMENTS

| | | | |
|---|---|---|---|
| 3,969,152 | 7/1976 | Melotik | 148/6.15 Z |
| 4,004,064 | 1/1977 | Kessler | 428/421 |
| 4,273,592 | 6/1971 | Kelly | 148/247 |
| 4,457,790 | 7/1984 | Lendert | 148/247 |
| 4,606,890 | 8/1986 | Fisk | 422/15 |
| 4,770,727 | 9/1988 | Siegl | 148/257 |

FOREIGN PATENT DOCUMENTS

| | | | |
|---|---|---|---|
| 0116338 | 9/1975 | Japan | 148/273 |
| 0163280 | 12/1981 | Japan | 148/257 |

*Primary Examiner*—Sam Silverberg
*Attorney, Agent, or Firm*—William J. Uhl

[57] ABSTRACT

This application relates to a water-based passivating composition comprising:

(a) an amino compound which is selected from the group consisting of an amino acid and salts thereof and an amino alcohol and salt thereof, and (b) a metal compound selected from a group IIIB transition metal compound, a group IVB transition metal compound and a rare earth metal compound.

9 Claims, No Drawings

NON-CHROME FINAL RINSE FOR PHOSPHATED METAL

FIELD OF THE INVENTION

The present invention relates to non-chrome passivating compositions which are employed as final rinses in the pretreatment of substrates. More specifically, the present invention relates to non-chrome final rinse compositions containing amino acids or amino alcohols or salts thereof in combination with transition metal compounds.

BRIEF DESCRIPTION OF THE PRIOR ART

In the pretreatment of substrates, particularly by phosphate conversion coating, final rinses are employed to enhance the corrosion resistance of the pretreated substrate. Chromic acid rinses are usually employed as final rinses. Given the present environmental and safety climate, it is now deemed desirable to replace chromic acid rinses.

U.S. Pat. No. 3,695,942 discloses non-chrome final rinses comprising an aqueous zirconium rinse solution consisting essentially of a soluble zirconium compound which is typically in the form of an alkali metal or ammonium salt of zirconium hydroxy carboxylate such as zirconium acetate or zirconium oxalate.

U.S. Pat. No. 3,895,970 discloses non-chrome final rinses comprising an acidic solution of certain fluoride ions obtained from calcium, zinc, zinc aluminum, titanium, zirconium, nickel, ammonium fluoride, hydrofluoric acid, fluoboric acid or a mixture thereof.

U.S. Pat. No. 4,457,790 discloses a treatment composition comprising a metal ion selected from the group consisting of titanium, hafnium and zirconium and a mixture thereof, and an effective amount of a soluble or dispersible treatment compound selected from the group consisting of a polymer which is a derivative of a polyalkenylphenol.

However, most non-chrome rinses have not risen to the level of commercially useful final rinses. Even though somewhat successful, the prior art non-chrome rinses tend not to consistently match the performance of chrome rinses. By the present invention there is provided an improved non-chrome final rinse composition.

SUMMARY OF THE INVENTION

In accordance with the foregoing, the present invention encompasses a water-based passivating composition comprising: (a) an amino compound which is an amino acid, an amino alcohol or a salt thereof, and (b) a group IIIB or IVB transition metal compound or rare earth metal compound. Preferably the amino compound is an alpha, beta or gamma amino compound or a cyclic amino compound having an amine group and a hydroxyl group or acid group on the same ring. In a presently preferred embodiment of the invention, the amino compound is sarcosine or glycine and the transition metal compound is a zirconium compound such as fluozirconic acid and its salts.

As a final rinse, the preferred compositions of the present invention have been found to perform at least as well as the commonly used chrome-containing final rinses without the associated problem of chromic acid. This and other aspects of the invention are more fully described hereinbelow.

DETAILED DESCRIPTION OF THE INVENTION

As aforestated, the water-based passivating composition of the present invention comprises (a) an amino compound which is an amino acid, an amino alcohol or a salt thereof, and (b) a group IIIB or IVB transition metal compound or rare earth metal compound. Preferably the amino compound is an alpha, beta or gamma amino compound or a cyclic amino compound having an amine group and a hydroxyl group or acid group on the same ring. The pH of the composition can be from about 2.0 to 8.0 and preferably from about 3.5 to 6.0, at a temperature of 15° to 100° C. and preferably 30° to 60° C.

The group IIIB and IVB transition metals and rare earth metals referred to herein are those elements included in such groups in the CAS Periodic Table of the Elements as is shown, for example, in the *Handbook of Chemistry and Physics,* 63rd Edition (1983).

The useful amino compound can be primary, secondary, tertiary, or quaternary amine. Specific examples of the alpha amino compounds can be sarcosine, glycine and oleyl imidazoline. The preferred alpha amino compounds can be sarcosine and glycine. In a particularly preferred embodiment of the invention, the alpha amino acid compound is a substituted or an unsubstituted glycine. The substituted glycine can be sarcosine, iminodiacetic acid, leucine or tyrosine. Illustrative but non-limiting examples of the beta amino acid compounds are taurine and N-methyl taurine. An illustrative but non-limiting example of the gamma amino acid compound is gamma aminobutyric acid. Illustrative but non-limiting examples of the cyclic amino compound having an amine group and an acid group on the same ring are aminobenzoic acid and derivatives thereof. Illustrative but non-limiting examples of the beta amino alcohol compounds are imidazoline and derivatives thereof, choline, triethanolamine, diethanol glycine and 2-amino-2-ethyl-1,3-propanediol. An illustrative but non-limiting example of the gamma amino alcohol compounds is aminopropanol. Illustrative but non-limiting examples of the cyclic amino compounds having an amine group and a hydroxyl group on the same ring are amino phenols and derivatives thereof.

The amino compound is present at a level of about 50 to 100,000 parts per million. Preferably the amino compound is present at a level of about 100 to 10,000 parts per million.

Preferred group IIIB and IVB transition metal compounds and rare earth metal compounds are compounds of zirconium, titanium, hafnium and cerium and mixtures thereof. Typical examples of the zirconium compound can be selected from the group consisting of acids or acid salts of zirconium such as alkali metal or ammonium fluozirconates, zirconium carboxylates and zirconium hydroxy carboxylates, e.g., hydrofluozirconic acid, zirconium acetate, zirconium oxalate, ammonium zirconium glycolate, ammonium zirconium lactate, ammonium zirconium citrate or the like. A preferred zirconium compound can be fluozirconic acid or its salts. A preferred example of the titanium compound can be fluotitanic acid or its salts. A preferred example of the hafnium compounds is hafnium nitrate. A preferred example of the cerium compounds is cerous nitrate.

The transition or rare earth metal compound is present at a level of 10 to 10,000 parts per million and preferably at a level of about 25 to 1,500 parts per million.

In the process of preparing the non-chrome rinse composition of this invention, the amino acid or amino alcohol can be blended with the transition metal compound in the presence of water. Other ingredients that can be employed herein can be acids such as nitric, acetic, and sulfamic and bases such as sodium hydroxide, ammonia and potassium hydroxide. Such acids and bases would be used to adjust the pH of the bath. It may also be desirable to include an organic solvent in the bath.

In the practice of the invention, the non-chrome final rinse composition is applied to a substrate that had been pretreated by conversion coating with, say, a phosphate conversion coating. The rinse composition can be applied by spray or immersion techniques. The rinse time should be as long as would ensure sufficient wetting of the surface with the rinse composition. Typically, the rinse time is from about 5 sec. to 10 min. and preferably from 15 sec. to 1 min. over a temperature range of about 15° C. to 100° C. and preferably 30° C. to 60° C. After the final rinse, the metal is usually dried either by air drying or forced drying. In some instances, a water rinse is employed after the final rinse. A protective or decorative coating is usually applied to the substrate after it had been pretreated as set forth above.

It has been found that metal substrates that have been pretreated by phosphate conversion coating followed by a final rinse with the preferred non-chrome rinse compositions of this invention have been found to exhibit corrosion resistance and adhesion which is at least equivalent to the results obtained in the instance of using chrome containing final rinses. This and other aspects of the invention are further illustrated by the following non-limiting examples.

EXAMPLES

The following examples show the non-chrome rinse of this invention, the methods of preparing and using the same, and the comparison of the claimed rinses with art-related compositions.

The panels treated in the examples that follow have all been pretreated in the following process sequence unless otherwise noted in the example.

Prewipe with "CHEMKLEEN 340", which is a mildly alkaline prewipe cleaner available from Chemfil Corporation (Chemfil).

Stage #1 "CHEMKLEEN 48L" which is an alkaline cleaner available from Chemfil (Alkaline clean), spray 1% by volume at 135°-140° F. for 1 minute.

Stage #2 Hot water rinse, by spraying at 135°-140° F., for 30 seconds.

Stage #3 CHEMFOS 158 (iron phosphate conversion coating available from Chemfil), by spraying Total Acid 11.0-13.0 ml (3.8% by volume) Acid consumed titration 0.3-0.7 ml 145°-150° F. for 1 minute Stage #4 Ambient water rinse, by spraying at ambient temperature for 30 seconds Stage #5 Final or Post rinse, by immersion for 30 seconds (chrome rinse ambient, non-chrome 120° F.)

Stage #6 Deionized water rinse, by spraying at ambient temperature

All final rinses were adjusted to the indicated pH in the Tables to follow, with solutions of sodium hydroxide and/or nitric acid.

All the panels were painted with DURACRON 200 which is an acrylic type coating available from PPG Industries, Inc. (PPG). Panels were scribed diagonally to form a large X and placed in salt spray chambers as per ASTM B117. The panels were then removed and rated as follows: One diagonal scribe was rubbed with a mild abrasive pad to remove any excess rust. Tape was applied to the scribe and then removed vigorously to pull off any delaminated paint. Three one-inch sections each on the top and the bottom of the diagonal were marked off. The maximum width of paint delamination in each one inch section was measured, and these six measurements were averaged to give the rating of the panel.

EXAMPLE 1

Zirconium was added as Hydrofluozirconic acid ($H_2ZrF_6$), produced by Cabot Company, and sarcosine were added as a 40% by weight solution of sodium sarcosinate, produced by W. R. Grace Co. Panels were tested in neutral salt spray for 504 hours (3 weeks). The results for these tests are shown in the following Table I.

TABLE I

| Panel set # | Zirconium (ppm) | Sarcosine (ppm) | pH | creep (mm) |
|---|---|---|---|---|
| 0 | Deionized water blank | | | 13, 15 |
| 16 | Chrome control 0.25% CS 20 | | 4.06 | 5, 6 |
| 25 | 100 | (Zr-only control; CHEMSEAL 19 0.5%) | 4.28 | 2, 3 |
| 1 | 175 | 900 | 4.90 | 2, 1 |
| 3 | 175 | 100 | 4.64 | 3, 1 |
| 6 | 100 | 900 | 3.86 | 4, 4 |
| 10 | 175 | 500 | 3.81 | 3, 4 |
| 13 | 100 | 500 | 4.79 | 3, 2 |

EXAMPLE 2

The compositions shown in Table II were tested in a manner similar to Example 1. The results are shown in Table II.

TABLE II

| Panel set # | Zirconium (ppm) | oleyl imidazoline (ppm) | pH | creep (mm) |
|---|---|---|---|---|
| 0 | Deionized water blank | | | 14, 14 |
| 19 | Chrome control (0.25% CHEMSEAL 20) | | | 3, 3 |
| 1 | 175 | 900 | 4.47 | 5, 3 |
| 5 | 100 | 900 | 5.03 | 4, 2 |
| 7 | 100 | 100 | 5.09 | 2, 2 |
| 9 | 175 | 500 | 4.95 | 2, 2 |
| 14 | 100 | 500 | 4.45 | 3, 4 |
| 17 | 100 | 500 | 5.55 | 2, 5 |

EXAMPLES 3-4

The compositions listed in Tables III and IV below were tested in a manner similar to Example 1. All compounds were tested at 500 ppm except where noted. All non-chrome final rinses were run at 120° F.

A significant difference between the previous Tables and Tables III, IV and V to follow is that the test panels were pulled from test, taped, and rated on a weekly basis. This is a more severe test than only taping at the end of the test. Results at the end of three weeks are reported below, except that which were removed earlier than three weeks are noted.

TABLE III

| Compound tested | Zirconium (ppm) | pH | creep (mm) |
|---|---|---|---|
| CHEMSEAL 20, 0.25% | — | 4.50 | 3, 3 |
| Deionized water (blank) | — | — | fail (2 wks) |
| CHEMSEAL 19, 0.5% | 100 | 4.00 | 10, 8 |
| Triethanolamine | 0 | 4.00 | 14, 25 (2 wks) |
| Triethanolamine | 100 | 3.95 | 5, 5 |

TABLE IV

| Compound tested | Zirconium (ppm) | pH | creep (mm) |
|---|---|---|---|
| CHEMSEAL 20, 0.25% | — | 4.08 | 4, 6 |
| Deionized water (blank) | — | — | fail (2 wks) |
| CHEMSEAL 19, 0.5% | 100 | 4.16 | 10, 8 |
| Tyrosine (814 ppm) | 100 | 4.02 | 9, 7 |
| Glycine (338 ppm) | 100 | 4.07 | 5, 7 |
| o-Aminophenol-4-sulfonamide | 0 | 4.03 | 13, 15 (2 wks) |
| o-Aminophenol-4-sulfonamide | 100 | 3.85 | 7, 6 |
| Choline | 0 | 3.95 | 12, 13 (2 wks) |
| Choline | 100 | 4.03 | 5, 9 |
| 2-amino-2-ethyl-1,3-propanediol | 0 | 4.05 | fail (2 wks) |
| 2-amino-2-ethyl-1,3-propanediol | 100 | 3.92 | 7, 6 |

EXAMPLE 5

Table V shows the comparative performance of a version of the novel non-chrome rinse on a cleaner-coater iron phosphate coating, which is inherently poorer coating. The process sequence for these panels differed in that the prewipe and stages 1 and 2 were eliminated, and stage 3 was charged with CHEMFOS L24-D, which is an iron phosphate type cleaner-coater available from Chemfil, at 3% (total acid 5.8 ml). Other operating variables were the same.

TABLE V

| Compound tested | Zirconium (ppm) | pH | creep (mm) |
|---|---|---|---|
| CHEMSEAL 20, 0.25% | — | 4.22 | 5, 3 |

TABLE V-continued

| Compound tested | Zirconium (ppm) | pH | creep (mm) |
|---|---|---|---|
| Deionized water (blank) | — | — | fail (2 wks) |
| CHEMSEAL 19, which is a zirconium only final rinse available from Chemfil | 150 | 4.25 | 18, 13 |
| Sodium Sarcosinate (500 ppm) | 100 | 4.13 | 9, 7 |

What is claimed is:

1. A process for treating a phosphated metal surface comprising contacting said phosphated metal surface with a water-based composition comprising:

(a) an amino compound present at a level about 50 to 100,000 parts per million, which is an amino acid or an amino alcohol, said amino acid being selected from the group consisting of glycine, sarcosine, iminodiacetic acid, leucine, tyrosine, taurine, N-methyl taurine, aminobenzoic acid, gamma-aminobutyric acid and salts thereof; said amino alcohol being selected from the group consisting of imidazoline, oleyl imidazoline, choline, triethanolamine, diethanol glycine, ethanol diglycine, 2-amino-2-ethyl-1,3-propanol and amino-propanol; and (b) a group IVB metal compound.

2. The process of claim 1 wherein the amino compound is present at a level of about 100 to 10,000 parts per million.

3. The process of claim 1 wherein the Group IVB metal compound is present at a level of 10 to 10,000 parts per million.

4. The process of claim 1 wherein the Group IVB metal compound is present at a level of about 25 to 1500 parts per million.

5. The process of claim 1 in which the water-based composition has a pH of about 2.0 to 8.0.

6. The process of claim 1 in which the water-based composition has a pH of about 3.5 to 6.0.

7. The process of claim 1 in which the water-based composition is at a temperature of 15° to 100° C.

8. The process of claim 1 in which the water-based composition is at a temperature of 30° to 60° C.

9. The process of claim 1 in which the phosphated metal surface is an iron phosphated substrate.

* * * * *